United States Patent [19]

Fezatt et al.

[11] 4,216,833

[45] Aug. 12, 1980

[54] PLOW BLADE ATTACHMENT

[76] Inventors: Peter W. Fezatt, P.O. Box 2407; James A. Harvey, Box 1213; Ronald A. Harvey, Rte. 3, Box 86AA, all of Orofino, Id. 83544

[21] Appl. No.: 900,412

[22] Filed: Apr. 27, 1978

[51] Int. Cl.[2] ..... F02F 3/76

[52] U.S. Cl. ..... 172/805; 37/DIG. 12; 37/50

[58] Field of Search ..... 172/805, 777, 809, 804, 172/801; 214/145 R; 37/DIG. 3, DIG. 12, 117.5, 50, 41, 42 R

[56] References Cited

U.S. PATENT DOCUMENTS

| | | | |
|---|---|---|---|
| 2,515,384 | 7/1950 | Carnop | 37/117.5 |
| 2,529,208 | 11/1950 | Anderson | 37/DIG. 3 |
| 2,702,952 | 3/1955 | Le Tourneau | 172/805 |
| 3,439,752 | 4/1969 | Coontz | 172/805 |
| 3,521,713 | 7/1970 | Spanjer | 172/809 X |
| 3,866,342 | 2/1975 | Cooper | 172/801 |

*Primary Examiner*—Richard J. Johnson

*Attorney, Agent, or Firm*—Wells, St. John & Roberts

[57] ABSTRACT

An attachment is disclosed that is mountable to a scraper blade carried on a powered vehicle such as a log skidder. The attachment is easily mounted and removed from the scraper blade to enable a log skidder to clear roadways of snow and other loose materials. The attachment includes a carrying frame that is releasably mountable directly to the scraper blade. A plow blade is pivotably mounted to the carrying frame. The plow blade is selectively pivotal at its center about a vertical axis to alternate positions forming acute angles with respect to the scraper blade. Therefore, loose material may be plowed to either side of the path desired to be cleared by the blade. Struts are provided that are interchangeable at opposite ends of the blade to enable selective angular positioning of the plow blade.

7 Claims, 6 Drawing Figures

PLOW BLADE ATTACHMENT

BACKGROUND OF THE INVENTION

Heavy hauling equipment such as log skidders are often provided with scraper blades for clearing a path through wooded or otherwise limited access areas. Such blades are perpendicular to the path of travel of the vehicle and are acceptable for their intended purpose, that of pushing logs and debris. However, the scraper blade is unsatisfactory for plowing operations such as snow removal. A perpendicular blade is inefficient for such use because the material will build up in front of the blade as the vehicle moves forwardly. An angled plow blade, on the other hand, will continuously discharge material to one side of the path as the vehicle moves forwardly.

It is not practical to purchase a complete plow blade assembly along with mounting brackets to replace the conventional pusher blade of machines such as log skidders. The expense involved and time required to remove the existing scraper blade and replace it with a plow blade is prohibitive.

It has therefore become desirable to provide some form of plow blade attachment that may be mounted directly to a scraper blade that may be the functional equivalent of a standard adjustable plow blade that will deposit material on either side of the intended path to be plowed.

BRIEF DESCRIPTION OF THE DRAWINGS

A preferred form of the present invention is illustrated in the accompanying drawings in which.

DETAILED DESCRIPTION OF A PREFERRED EMBODIMENT

Figure 1:
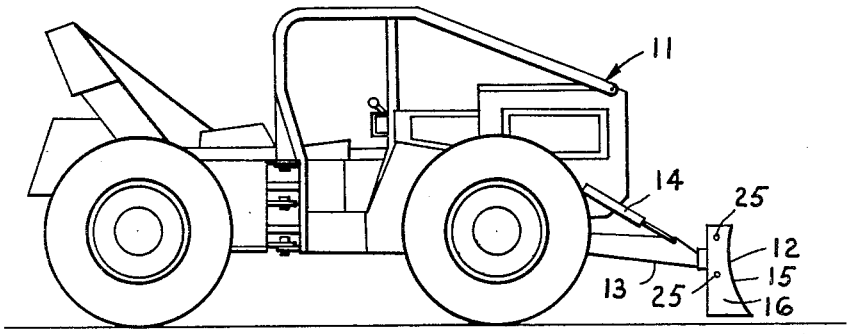
FIG. 1 is a side elevational view of a conventional log skidder with a scraper blade mounted thereon and modified to receive the present attachment.

A preferred form of the present attachment is illustrated in the accompanying drawings and is generally designated therein by the reference character 10. The attachment 10 is mountable to a logging vehicle such as the skidder illustrated in FIG. 1 at 11. Such a skidder 11 includes a forward scraper blade 12 mounted by a frame 13 in a perpendicular relationship to the intended forward direction of travel. Typically, cylinders 14 are provided to selectively elevate the scraper blade 12 between the lowered position shown and an elevated position. The blade will remain in its perpendicular relationship to the forward path of travel regardless of its elevational position. The blade 12 usually will include a forward ground engaging convex surface 15 that extends between its opposite ends 16. Blade 12 releasably mounts the present attachment 10 as shown in substantial detail by FIGS. 2 through 6.

Attachment 10 includes a carrying frame 20 of a substantially "A" frame shape that is removably mountable to the scraper blade 12. It extends to ends 21 that are spaced apart by a distance substantially equal to the length or distance between the ends 16 of the scraper blade 12. A bracket means 22 is provided on frame 20 to mount the carrying frame 20 to the scraper blade 12.

The bracket means 22 may include mounting plates 23 at the opposite ends 21 of frame 20 along with appropriate mounting holes 24 for alignment with holes 25 (FIG. 1) previously drilled in the ends 16 of the scraper blade 12. Bolts 26 will fit through holes 24 and 25 to securely mount the carrying frame 20 to the scraper blade 12. When so mounted, a cross member **20*a* of the carrying frame 20 engages the scraper blade surface 15** along its entire length to provide bearing support.

A plow blade 27 is adjustably mounted to the carrying frame 20. The blade 27 extends between opposite ends 28 and includes a concave earth engaging surface 29. A rearwardly facing surface 20 is opposite surface 29.

A mounting means 31 and brace means 32 releasably and adjustably mount the plow blade 27 to the carrying frame 20. Mounting means 31 allows pivotal movement of the blade between a left and a right inclined orientation with respect to the scraper blade and the intended direction of travel. The brace means 32 facilitates secure positioning of the blade in either selected angular position relative to the scraper blade 12.

Figure 2:
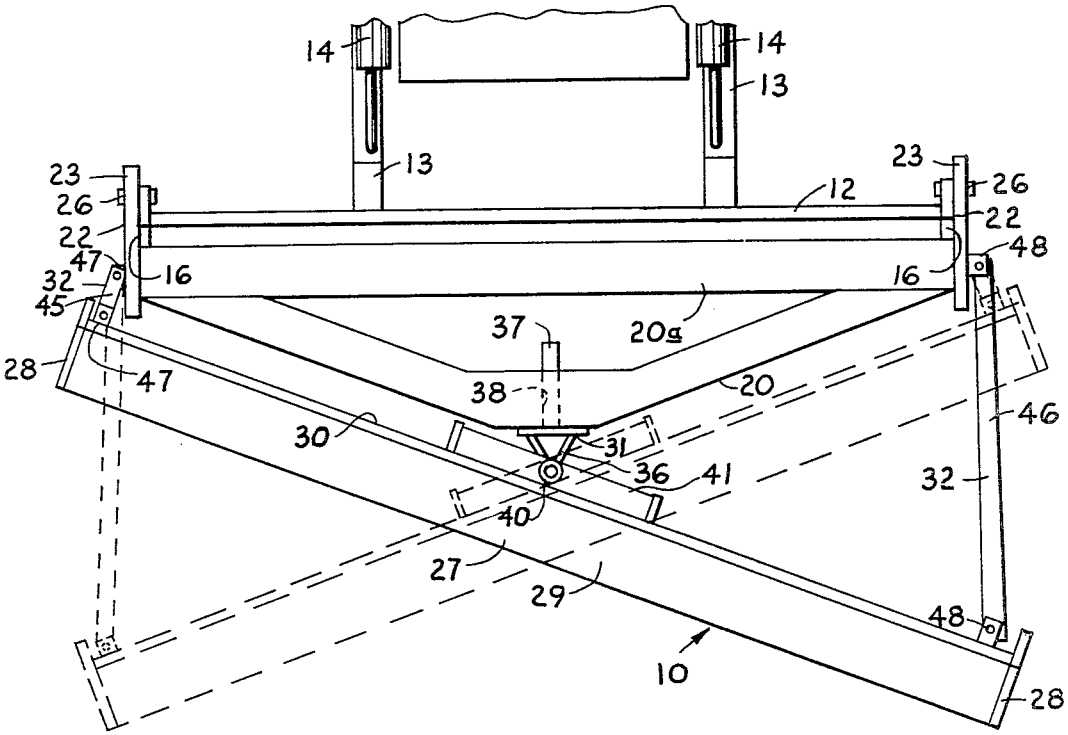
FIG. 2 is a plan view of the scraper blade with the present attachment mounted thereon.
Figure 3:
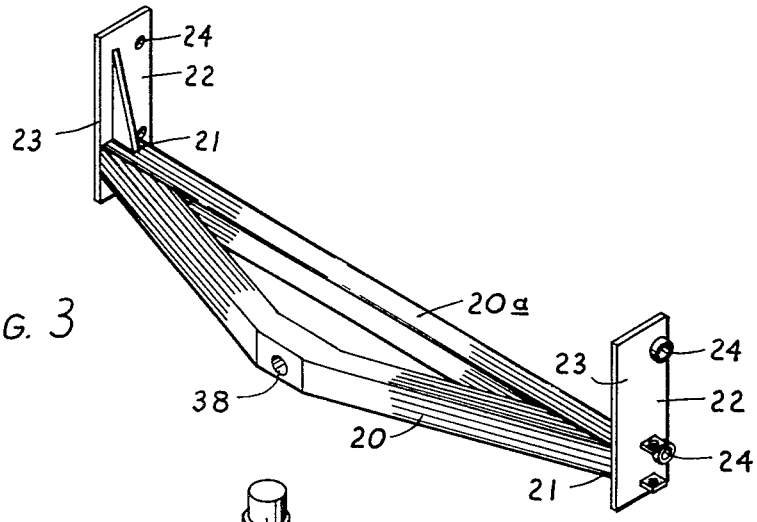
FIG. 3 is a pictorial view of a carrying frame of the present invention.
Figure 4:
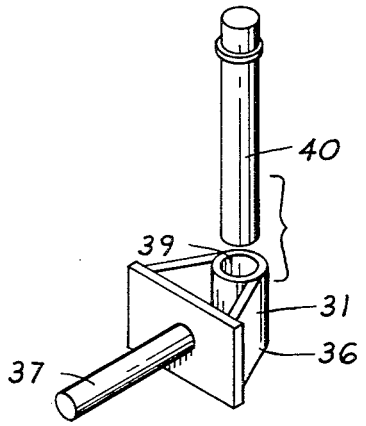
FIG. 4 is a pictorial detail view of a portion of a mounting means.
Figure 5:
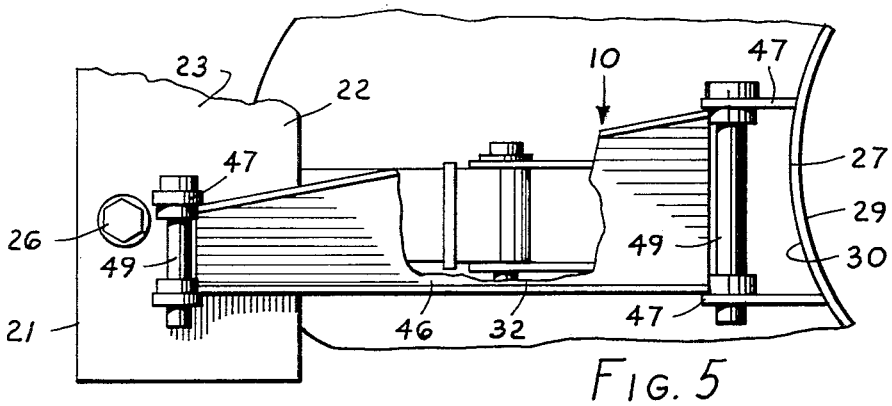
FIG. 5 is an enlarged fragmentary side elevational view showing a portion of a brace means.

Mounting means 31 may be best described with reference to FIGS. 2 through 4. It may include a bracket 36 that removably interconnects the carrying frame 20 and blade 27 at points midway between their ends 21 and 28. The bracket is illustrated in detail in FIG. 4. It includes a rearwardly extending pin 37 that is releasably received within a central hole 38 centered on the carrying frame 20. The bracket 36 also includes an upright pin receiving bore 39. A pin 40 is releasably received within the bore 39 and also extends through appropriate apertures in a mounting flange 41 on the plow blade 27. As shown in FIG. 5, the bracket portion including the bore 39 is received between upper and lower portions of flange 41 to receive the pin 40. The bracket 36 and pin 40 arrangement enable free pivotal movement of the plow blade 27 about a vertical axis centered along the carrying frame 20 and plow blade 27.

The brace means 32 may include a pair of struts, a short strut 45 and a long strut 46. Struts 45 and 46 are mounted between pairs of brackets 47 (on the left side as viewed in FIG. 2) and bracket pairs 48 (on the right side in FIG. 2). Pins 49 extend through the ends of struts 45 and 46 and interconnected brackets 47 and 48 to secure the plow blade 27 against pivotal movement about the vertical axis defined by the pin 40.

Figure 6:
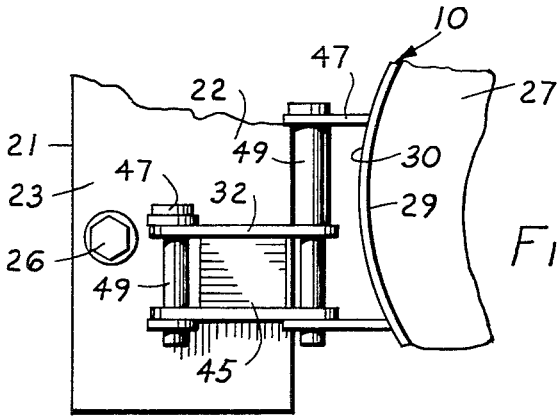
FIG. 6 is a view similar to FIG. 5 only showing a different operational relationship between the elements shown.

It should be noted that the struts 45 and 46 are interchangeable between the brackets 47 and 48. This feature is best illustrated in FIGS. 5 and 6 which show the same end 21 of the frame mounting both struts 46 and 47. FIG. 5 shows the long strut 46 mounted between the bracket pairs 47 and FIG. 6 shows the short strut 45 mounted between the same brackets 47. This is possible because the brackets 47 are identical with the brackets 48 and the opposite ends of either strut 46 or 47 are freely received between the brackets 47 or 48 on either frame end 21. Therefore, the struts 45 and 46 may be exchanged as shown by FIGS. 5 and 6 to secure the plow blade 27 at acute angles to the scraper blade 12 on either end thereof. The plow blade 27 will therefore make an acute angle with the blade 12 at the left side or end 16 thereof as viewed in FIG. 2 and, when the struts 45 and 46 are interchanged, the scraper blade 12 and plow blade 27 will make an acute angle at the opposite end 16 of the scraper blade 12 (not shown).

Installation of the present attachment is relatively simple and requires little time and effort. Firstly, the existing scraper blade 12 is drilled to include the mounting holes 25 in the scraper blade ends 16. The carrying frame may then be quickly secured to the blade 12 by bolts 26. After this is done, the vehicle may be maneuvered to align the hole 38 with the bracket pin 37. This eliminates time consuming hoisting mechanisms and methods of lifting a blade into engagement with its mounting frame. Once the pin is in place within the hole 38, the operator may actuate the cylinders 14 to lift the plow blade 27 off the ground. Once this is done, the installer may freely swing the plow blade 27 to either the dashed or solid line position shown in FIG. 2. Brace means 32 is then attached to secure the plow blade 27 in the selected position.

The brace means 32 is secured firstly by situating one of the struts 45 or 46 between an appropriate pair of brackets 47 on the carrying frame ends 21 and plow blade ends 28. Pins 49 may then be dropped through aligned apertures in the ends of the brackets and struts to releasably secure the plow blade 27 in position.

The attachment is then ready for operation. During use, the plow blade 27 may be lowered into engagement with the ground surface and moved in a forward direction of travel. Loose material such as snow engaged by the plow blade will be driven forwardly and toward the side of the blade that has been tilted back during the mounting process. If it is desired to form a windrow on the opposite side, the struts 45 and 46 are simply removed and exchanged side for side. The blade, once the struts are removed, can be freely pivoted to the opposite acute angle with relative ease.

It is to be understood that the above description is given merely as an example and that various changes and modifications therein can be made without departing from the scope of my invention. The scope of the present invention is restricted only by the following claims.

What we claim is:

1. A plow blade attachment mountable to a scraper blade carried by a log skidder in which the scraper blade has a front face extending transversely between scraper blade ends; comprising:

carrying frame means having a cross member adapted to engage and bear against the full width of the scraper blade front face between the scraper blade ends, said carrying frame means having spaced outer ends corresponding respectively to the scraper blade ends;

bracket means at the outer ends of the carrying frame means for removably fixing the carrying frame means to the respective scraper blade ends;

a plow blade;

mounting means centered between the outer ends of said carrying frame means for pivotally joining the center of the plow blade to the carrying frame means about a center vertical axis for selective angular adjustment relative to the scraper blade;

and first and second brace means operatively connected between the outer ends of the carrying frame means and said plow blade for selectively fixing the angular position of the plow blade relative to the carrying frame means about said center axis so the plow blade may be angularly oriented and secured to make an acute angle with the scraper blade.

2. The attachment as defined by claim 1 wherein the first and second brace means are each comprised of (1) a strut extending from one end of the plow blade to the corresponding end of the carrying frame means and (2) a pair of brackets removably connected to opposite ends of the strut, one bracket of each pair being fixed to the plow blade and the remaining bracket being fixed to the carrying frame means.

3. The attachment as defined by claim 1 wherein the first and second brace means is comprised of a pair of struts, one being longer than the other, said struts being removably connected between corresponding ends of the plow blade and the carrying frame means and wherein the struts are interchangeable to alternate the angular inclination of the plow blade relative to the scraper blade.

4. The attachment as defined by claim 1 wherein the mounting means is removable from the carrying frame and plow blade.

5. The attachment as defined by claim 1 wherein the mounting means is centrally located between ends of the plow blades and carrying frame and enables pivotal movement of the plow blade about a horizontal axis.

6. The attachment as set out in claim 1 wherein the mounting means pivotally supports the plow blade to the carrying frame means about a center axis which has an upright orientation when the carrying frame means is fixed to the scraper blade ends.

7. The attachment as set out in claim 1 wherein the mounting means pivotally supports the plow blade to the carrying frame means about a center axis which has a horizontal orientation when the carrying frame means is fixed to the scraper blade ends.

* * * * *